US008476518B2

(12) United States Patent
Padhi et al.

(10) Patent No.: US 8,476,518 B2
(45) Date of Patent: Jul. 2, 2013

(54) SYSTEM AND METHOD FOR GENERATING AUDIO WAVETABLES

(75) Inventors: Kabi P. Padhi, Singapore (SG); Jianhua Sun, Hong Kong (HK)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 178 days.

(21) Appl. No.: 10/999,376

(22) Filed: Nov. 30, 2004

(65) Prior Publication Data

US 2006/0112811 A1 Jun. 1, 2006

(51) Int. Cl.
*G10H 7/00* (2006.01)
*G10H 7/08* (2006.01)

(52) U.S. Cl.
USPC ..... 84/607; 84/616

(58) Field of Classification Search
USPC ..... 84/616, 654, 607
See application file for complete search history.

(56) References Cited

U.S. PATENT DOCUMENTS

| | | | | |
|---|---|---|---|---|
| 5,086,475 | A | 2/1992 | Kutaragi et al. | |
| 5,388,148 | A * | 2/1995 | Seiderman | 455/404.1 |
| 5,430,241 | A * | 7/1995 | Furuhashi et al. | 84/603 |
| 5,641,926 | A | 6/1997 | Gibson et al. | |
| 2003/0076348 | A1 | 4/2003 | Najdenovski | |
| 2003/0162571 | A1 * | 8/2003 | Chung | 455/567 |

OTHER PUBLICATIONS

Curtis Roads: "The Computer Music Tutorial", 1996, The MIT Press, 5 pages.
S.D. Trautmann et al., "Wavetable Music Synthesis for Multimedia and Beyond", 1997 IEEE, pp. 89-94.

* cited by examiner

*Primary Examiner* — Jeffrey Donels
(74) *Attorney, Agent, or Firm* — Munck Wilson Mandala, LLP

(57) ABSTRACT

A method includes receiving an audio signal and identifying one or more steady-state segments of the audio signal. The method also includes identifying at least one portion of the one or more segments that contains a specified frequency. Further, the method includes generating a wavetable using the at least one identified portion of the one or more segments. In addition, the method could include synthesizing an output audio signal using the wavetable. The output audio signal could represent a ringtone in a mobile telephone.

31 Claims, 4 Drawing Sheets

SYSTEM AND METHOD FOR GENERATING AUDIO WAVETABLES

TECHNICAL FIELD

This disclosure is generally directed to audio systems and more specifically to a system and method for generating audio wavetables.

BACKGROUND

The popularity of synthetic audio applications continues to rise in the United States and around the world. For example, many consumer devices are now available that generate audio signals by synthesizing the audio signals using wavetables. The wavetables store digitized sounds that are used by the consumer devices to generate audio signals on demand. As particular examples, gaming systems and multimedia applications often synthesize audio signals, such as when mobile telephones synthesize ringtones.

Synthesizing audio signals may be preferred over simply storing complete digital audio signals for several reasons. For example, synthesizing audio signals may generally require less storage space and less bandwidth for transmission. Also, synthesizing audio signals generally makes it easier for users to edit the audio signals.

A problem with conventional synthetic audio applications is that it is often difficult and time consuming to generate the wavetables used to synthesize audio signals. For example, generating a wavetable typically involves identifying sound segments that can be stored in the wavetable. However, identifying the sound segments is typically a subjective process that requires prior experience in analyzing audio signals. As a result, it is often a complex and time consuming process to identify sound segments and generate wavetables.

SUMMARY

This disclosure provides a system and method for generating audio wavetables.

In a first embodiment, a method includes receiving an audio signal and identifying one or more steady-state segments of the audio signal. The method also includes identifying at least one portion of the one or more segments that contains a specified frequency. In addition, the method includes generating a wavetable using the at least one identified portion of the one or more segments.

In a second embodiment, an apparatus includes an audio decomposer capable of identifying one or more steady-state segments of an audio signal. The apparatus also includes a wavetable generator capable of identifying at least one portion of the one or more segments that contains a specified frequency. The wavetable generator is also capable of generating a wavetable using the at least one identified portion of the one or more segments.

In a third embodiment, an apparatus includes one or more processors collectively capable of identifying one or more steady-state segments of an audio signal. The one or more processors are also collectively capable of identifying at least one portion of the one or more segments that contains a specified frequency. The one or more processors are further collectively capable of generating a wavetable using the at least one identified portion of the one or more segments. The apparatus also includes a memory capable of storing the wavetable.

In a fourth embodiment, a computer program is embodied on a computer readable medium and is capable of being executed by a processor. The computer program includes computer readable program code for identifying one or more steady-state segments of an audio signal. The computer program also includes computer readable program code for identifying at least one portion of the one or more segments that contains a specified frequency. In addition, the computer program includes computer readable program code for generating a wavetable using the at least one identified portion of the one or more segments.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
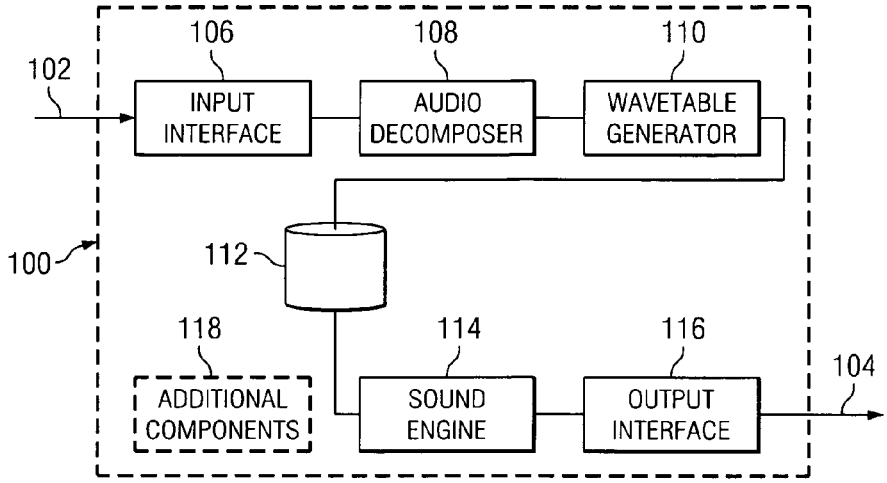
FIG. 1 illustrates an example audio processing apparatus according to one embodiment of this disclosure.

FIG. 1 illustrates an example audio processing apparatus 100 according to one embodiment of this disclosure. The embodiment of the audio processing apparatus 100 shown in FIG. 1 is for illustration only. Other embodiments of the audio processing apparatus 100 may be used without departing from the scope of this disclosure.

In general, the audio processing apparatus 100 receives and processes input audio signals 102. The audio processing apparatus 100 uses the input audio signals 102 to generate one or more wavetables. The wavetables are then used by the audio processing apparatus 100 to generate output audio signals 104. The input audio signals 102 and the output audio signals 104 may represent any suitable audio signals. For example, the input audio signals 102 and output audio signals 104 could contain frames of Pulse Code Modulation ("PCM") samples. The input audio signals 102 and output audio signals 104 could have any suitable quality, such as compact disc ("CD") quality where the signals have a sampling rate of 44,100 samples per second. The frames could contain any number of PCM samples, such as 2,048 samples per frame. In this document, the term "frame" refers to any unit containing multiple samples of audio information, such as PCM samples or other samples.

In this example embodiment, the audio processing apparatus 100 includes an input interface 106. The input interface 106 receives the input audio signals 102 from one or more sources of audio information. The input interface 106 includes any hardware, software, firmware, or combination thereof for receiving input audio signals 102. As particular examples, the input interface 106 could represent a structure for receiving an audio cable capable of transporting audio signals from a CD or digital video disc ("DVD") player. The input interface 106 could also represent a network interface capable of receiving audio signals over a wireless or wireline network. In addition, the input interface 106 could represent a structure capable of receiving audio signals from an audio source that is internal to the audio processing apparatus 100, such as when the apparatus represents a CD or DVD player.

Figure 3:
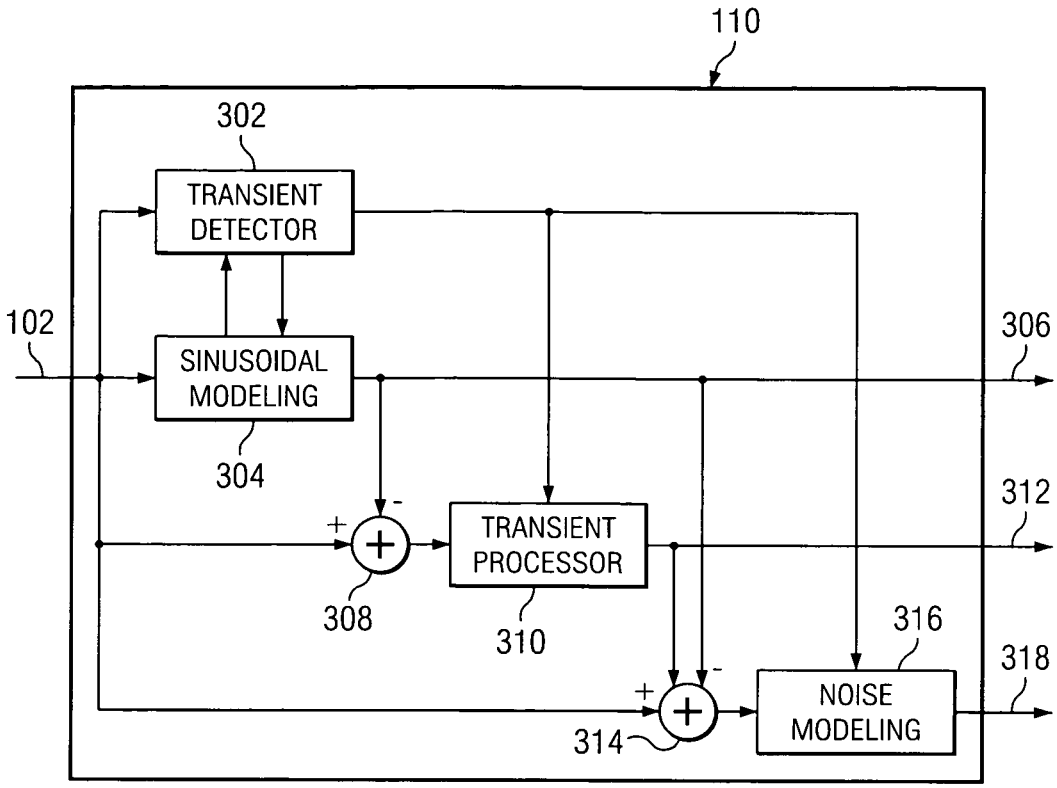
FIG. 3 illustrates an example audio decomposer according to one embodiment of this disclosure.

An audio decomposer 108 is coupled to the input interface 106. In this document, the term "couple" and its derivatives refer to any direct or indirect communication between two or more elements, whether or not those elements are in physical contact with one another. The audio decomposer 108 decomposes the input audio signals 102 into a form suitable for further processing by the audio processing apparatus 100. For example, the audio decomposer 108 could decompose the input audio signals 102 into sinusoids, noise, and transients, which represent the input audio signals 102 in the frequency domain. The audio decomposer 108 includes any hardware, software, firmware, or combination thereof for decomposing input audio signals 102. One example embodiment of the audio decomposer 108 is shown in FIG. 3, which is described below.

A wavetable generator 110 is coupled to the audio decomposer 108. The wavetable generator 110 uses the decomposed input audio signals to generate one or more wavetables. For example, the wavetable generator 110 may identify portions of the input audio signals 102 that may be repeated or looped to generate the output audio signals 104. The portions of the input audio signals 102 that can be looped may be referred to as "looping segments." The wavetable generator 110 may also identify other portions of the input audio signals 102 that could be used to generate the output audio signals 104. The identified portions of the input audio signals 102 are then stored in a wavetable. The wavetable generator 110 includes any hardware, software, firmware, or combination thereof for generating wavetables. One example embodiment of the wavetable generator 110 is shown in FIG. 5, which is described below.

A memory 112 is coupled to the wavetable generator 110. The memory 112 is capable of receiving and storing one or more wavetables generated by the wavetable generator 110. The memory 112 also facilitates retrieval of the stored wavetables. The memory 112 includes any suitable storage and retrieval device or devices. As examples, the memory 112 could include one or more solid-state memories (such as a multimedia memory card or a compact flash card), random access memories, hard disk drives, optical storage devices, or other volatile and/or non-volatile devices.

A sound engine 114 is coupled to the memory 112. The sound engine 114 is capable of retrieving one or more of the wavetables stored in the memory 112. The sound engine 114 uses the retrieved wavetable(s) to synthesize or otherwise generate the output audio signals 104. For example, the audio processing apparatus 100 could represent a mobile telephone, and the sound engine 114 could generate ringtones for the mobile telephone. The sound engine 114 includes any hardware, software, firmware, or combination thereof for generating audio signals using one or more wavetables.

An output interface 116 is coupled to the sound engine 114. The output interface 116 receives and provides the output audio signals 104 from the sound engine 114. For example, the output interface 116 could provide the output audio signals 104 for playback on a speaker or speaker system. The output interface 116 includes any hardware, software, firmware, or combination thereof for providing output audio signals 104. As particular examples, the output interface 116 could represent a structure for receiving an audio cable capable of transporting the audio signals or a network interface capable of transmitting audio signals over a wireless or wireline network. While FIG. 1 illustrates the use of an input interface 106 and a separate output interface 116, a single interface could be used as both the input interface 106 and the output interface 116.

In one aspect of operation, the audio decomposer 108 performs transient detection to decompose the input audio signals 102. The wavetable generator 110 uses the output of the transient detection to isolate steady-state signals in the input audio signals 102. The wavetable generator 110 also uses pitch detection and trajectory tracking techniques to isolate desired frequencies in the steady-state signals. Portions of the steady-state signals containing the desired frequencies are then stored in a wavetable. The stored portions represent portions of the input audio signals 102 that can be looped during synthesis of the output audio signals 104. In this way, the wavetable generator 110 may generate wavetables in a more efficient manner. In this document, the phrases "steady-state signal" and "steady-state segment" refer to any signal or part thereof that has a constant or relatively constant amplitude and frequency characteristics.

As a particular example, the audio processing apparatus 100 could represent a mobile telephone that uses the wavetables from the wavetable generator 110 to generate ringtones. The wavetable generator 110 generates the wavetables by extracting desirable portions of audio signals from different musical instruments. The extracted portions may then be used to compose customized ringtones using musical instruments preferred by the end user. The extracted portions could also be used to allow the end user to manually compose ringtones. In this example, the audio processing apparatus 100 includes additional components 118, such as a keypad, display, speaker, microphone, transceiver, antenna, and any other or additional components of a mobile telephone. In other embodiments, the additional components 118 could represent any other or additional components depending on the apparatus 100, such as a subband filter in an audio decoder.

Each of the components shown in FIG. 1 could be implemented using any suitable hardware, software, and/or firmware. For example, various components could be implemented in hardware. In other embodiments, various components could represent software routines stored in a memory and executed by one or more processors.

Although FIG. 1 illustrates one example of an audio processing apparatus 100, various changes may be made to FIG. 1. For example, the functional division shown in FIG. 1 is for illustration only. Various components in FIG. 1 may be combined or omitted and additional components could be added according to particular needs. As a particular example, if the input audio signals 102 represent analog signals, an analog-to-digital converter could be inserted between the input interface 106 and the audio decomposer 108. Also, FIG. 1 illustrates one example environment in which the wavetable generation technique described above could be used. The wavetable generation technique could be used in any other suitable apparatus or system.

Figure 2:
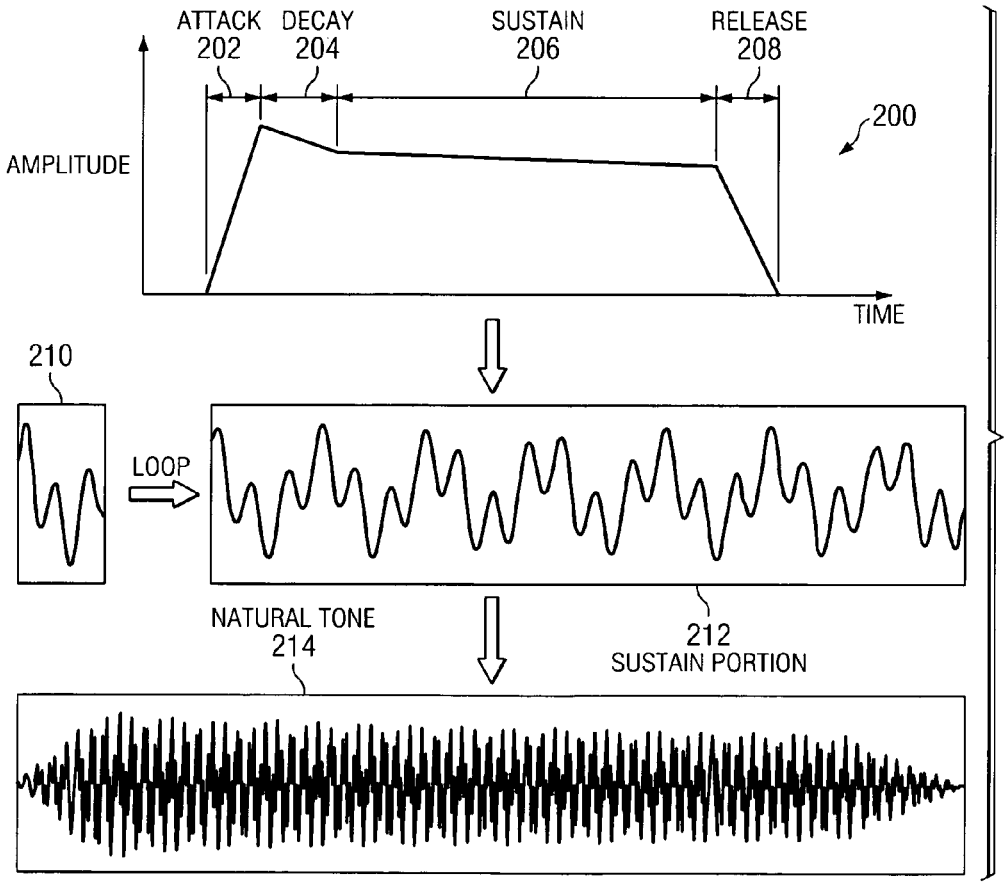
FIG. 2 illustrates an example audio synthesis using a wavetable according to one embodiment of this disclosure.

FIG. 2 illustrates an example audio synthesis using a wavetable according to one embodiment of this disclosure. In particular, FIG. 2 illustrates the operation of the audio processing apparatus 100 of FIG. 1. The operation of the audio processing apparatus 100 shown in FIG. 2 is for illustration only. The audio processing apparatus 100 may operate in any other suitable manner without departing from the scope of this disclosure.

In FIG. 2, a plot 200 illustrates the general stages or phases of a tone, such as a tone produced by a musical instrument and contained in the input audio signals 102. In some embodiments, the wavetable generator 110 generates wavetables that allow the sound engine 114 to generate tones having this format.

As shown in the plot 200, a tone is generally divided into four stages. An attack stage 202 represents the initial stage of a tone where the amplitude characteristics of an audio signal rapidly increase over a shorter period of time. A decay stage 204 represents the next stage of a tone where the amplitude characteristics decrease slightly over a shorter period of time. Following the decay stage 204 is a sustain stage 206, where the amplitude characteristics remain relatively constant over a longer period of time. The tone concludes with a release stage 208, where the amplitude characteristics rapidly decrease over a shorter period of time.

The sound engine 114 uses a wavetable to generate tones in an output audio signal 104 having this format. To help reduce the storage capacity needed for a wavetable, the wavetable generator 110 identifies a looping segment 210. The looping segment 210 represents a portion of an input audio signal 102 that can be repeated during the sustain stage 206. The looping segment 210 is stored in the wavetable. As shown in FIG. 2, the sound engine 114 generates a sustain portion 212 of a tone by looping the looping segment 210. The sound engine 114 then applies an envelope function to the sustain portion 212 to obtain a natural tone 214.

The selected looping segment 210 may have any suitable characteristics. For example, the looping segment 210 could have constant or relatively constant amplitude and frequency characteristics. The looping segment 210 could also have starting and ending points that are logically equivalent, which may help to reduce or eliminate discontinuities when looping the looping segment 210.

To select a looping segment 210, the wavetable generator 110 isolates steady-state signals in the input audio signals 102 and uses pitch detection and trajectory tracking techniques to isolate desired frequencies in the steady-state signals. Isolated portions of the steady-state signals containing the desired frequencies are then used as the looping segment 210 and stored in a wavetable.

Although FIG. 2 illustrates one example of audio synthesis using a wavetable, various changes may be made to FIG. 2. For example, the plot 200 could include any other or additional stages. Also, the looping segment 210, sustain portion 212, and natural tone 214 shown in FIG. 2 are for illustration only.

FIG. 3 illustrates an example audio decomposer 108 according to one embodiment of this disclosure. The embodiment of the audio decomposer 108 shown in FIG. 3 is for illustration only. Other embodiments of the audio decomposer 108 may be used without departing from the scope of this disclosure. Also, for ease of explanation, the audio decomposer 108 in FIG. 3 is described as operating in the audio processing apparatus 100 of FIG. 1. The audio decomposer 108 could be used in any other apparatus or system.

In this example, the audio decomposer 108 receives an input audio signal 102. The input audio signal 102 may, for example, be provided to the audio decomposer 108 by the input interface 106.

As described above, the audio decomposer 108 could decompose the input audio signal 102 into sinusoids, noise, and transients in the frequency domain. This type of decomposition may be suitable for use with audio signals because audio signals often include sudden changes in their time domain characteristics. This type of decomposition typically involves sinusoidal modeling and noise modeling.

The input audio signal 102 is provided to a transient detector 302. The transient detector 302 divides the input audio signal 102 in the time domain into different segments. For example, the transient detector 302 could divide the input audio signal 102 into segments having transients and segments that do not. Segments that do not have transients may be modeled using sinusoid and noise parameters, and segments having transients are modeled using transient parameters. The transient detector 302 includes any hardware, software, firmware, or combination thereof for segmenting an input audio signal 102.

A sinusoid modeling unit 304 is coupled to the transient detector 302. The sinusoid modeling unit 304 uses the output of the transient detector 302 to model segments of the input audio signal 102 that do not contain transients. For example, an input signal could be represented as the sum of (1) sinusoids of varying amplitudes and frequencies, (2) noise, and (3) transients. As a particular example, an input signal could be modeled using the equation:

$$s(n) = \sum_{m=1}^{L_k} A_m^l(n) \cdot \cos(\theta_m^l(n)) + t(n) + q(n) \tag{1}$$

where s(n) represents the signal, $L_k$ represents the maximum number of frequencies in a frame containing samples of the signal, $A^l_m(n)$ and $\theta^l_m(n)$ represent the amplitude and phase of the $m^{th}$ sinusoid in the $l^{th}$ frame of the signal, n represents a time index, t(n) represents the transient portion of the signal, and q(n) represents the noise portion of the signal. In segments of the input audio signal 102 that do not contain transients, the sinusoid modeling unit 304 identifies the amplitudes and phases of the sinusoids representing those segments. The amplitudes and phases are output as sinusoids 306. The sinusoid modeling unit 304 includes any hardware, software, firmware, or combination thereof for identifying sinusoids representing an audio signal.

The identified sinusoids 306 are provided to a combiner 308. The combiner 308 subtracts the sinusoids 306 from the input audio signal 102. The combiner 308 then outputs the difference. The combiner 308 includes any hardware, software, firmware, or combination thereof for combining two or more signals.

The outputs of the transient detector 302 and the combiner 308 are received by a transient processor 310. The transient processor 310 processes the received signals to identify and output information identifying the transients in the input audio signal 102. For example, the transient processor 310 could identify the t(n) term in Equation (1) above. The identified transients are output as transients 312. The transient processor 310 includes any hardware, software, firmware, or combination thereof for identifying transients representing an audio signal.

The identified sinusoids 306 and the identified transients 312 are provided to a combiner 314. The combiner 314 subtracts the sinusoids 306 and the transients 312 from the input audio signal 102. The combiner 314 then outputs the difference. The combiner 314 includes any hardware, software, firmware, or combination thereof for combining two or more signals.

The outputs of the transient detector 302 and the combiner 314 are received by a noise modeling unit 316. The noise modeling unit 316 processes the received signals to identify and output information identifying the noise component representing the input audio signal 102. For example, the noise modeling unit 316 could identify the q(n) term in Equation (1) above. The identified noise is then output as noise 318. The noise modeling unit 316 includes any hardware, software, firmware, or combination thereof for identifying noise representing an audio signal.

The following description describes an example operation of the audio decomposer 108. The description of the operation of the audio decomposer 108 is for illustration only. The audio decomposer 108 could operate in other ways without departing from the scope of this disclosure.

Transients in an input audio signal 102 may change very quickly in time and frequency. It may be difficult to model sinusoids for signals that include transients, such as transients that occur during the attack stage 202. To help model the input audio signal 102, the transient detector 302 determines when the input audio signal 102 switches between regions that can be represented by sinusoids 306 and noise 318 (regions without transients) and regions that can be represented by transients 312 (regions with transients).

The transient detector 302 may use any suitable technique to detect transients in the input audio signal 102. For example, one technique may involve examining rising edges in the short-time energy of the input audio signal 102. The transient detector 302 acts as a rising edge detector or predictor that compares a current frame's energy estimate and an average or weighted sum of prior frames' energies. If the current frame's energy is larger than the average or weighted sum of the prior frames' energies by a threshold amount, the transient detector 302 treats the current frame as a candidate for containing a transient.

As another example, the transient detector 302 could identify a difference or residual between an input audio signal 102 and a synthesized version of the input audio signal 102 (the output audio signal 104). The short-time energy of the residual is determined. At each frame l with a hop size M, a ratio is taken between the short-time energies using the equation:

$$\text{ratio}\ (l) = \frac{\text{residual energy}\ (l)}{\text{original energy}\ (l)} = \frac{\sum_{n=l\cdot M}^{l(M+1)-1} h(n)\cdot[y(n)-x(n)]^2}{\sum_{n=l\cdot M}^{l(M+1)-1} h(n)\cdot x^2(n)} \quad (2)$$

where x(n) represents the original signal 102, y(n) represents the synthesized signal generated using sinusoidal modeling, and h(n) represents an analysis window. When the ratio is zero or approximately zero, the sinusoidal modeling may have produced a reasonable representation of the original. A ratio close to one may indicate that a frame may contain samples representing the onset of a transient.

In one or both of these techniques, a dynamic range control algorithm could be used to dynamically set thresholds for detection of transients. Also, in other embodiments, both of these techniques could be used in combination by the transient detector 302.

The audio decomposer 108 could operate under the assumption that the sinusoidal parameters are reasonably stationary before and after transients in the input audio signal 102. The transients may be extrapolated from the analysis windows just before and after the transient region and cross-faded over a period of time.

Although FIG. 3 illustrates one example of an audio decomposer 108, various changes may be made to FIG. 3. For example, the functional division of the audio decomposer 108 shown in FIG. 3 is for illustration only. Various components in FIG. 3 may be combined or omitted and additional components could be added according to particular needs.

Figure 4:
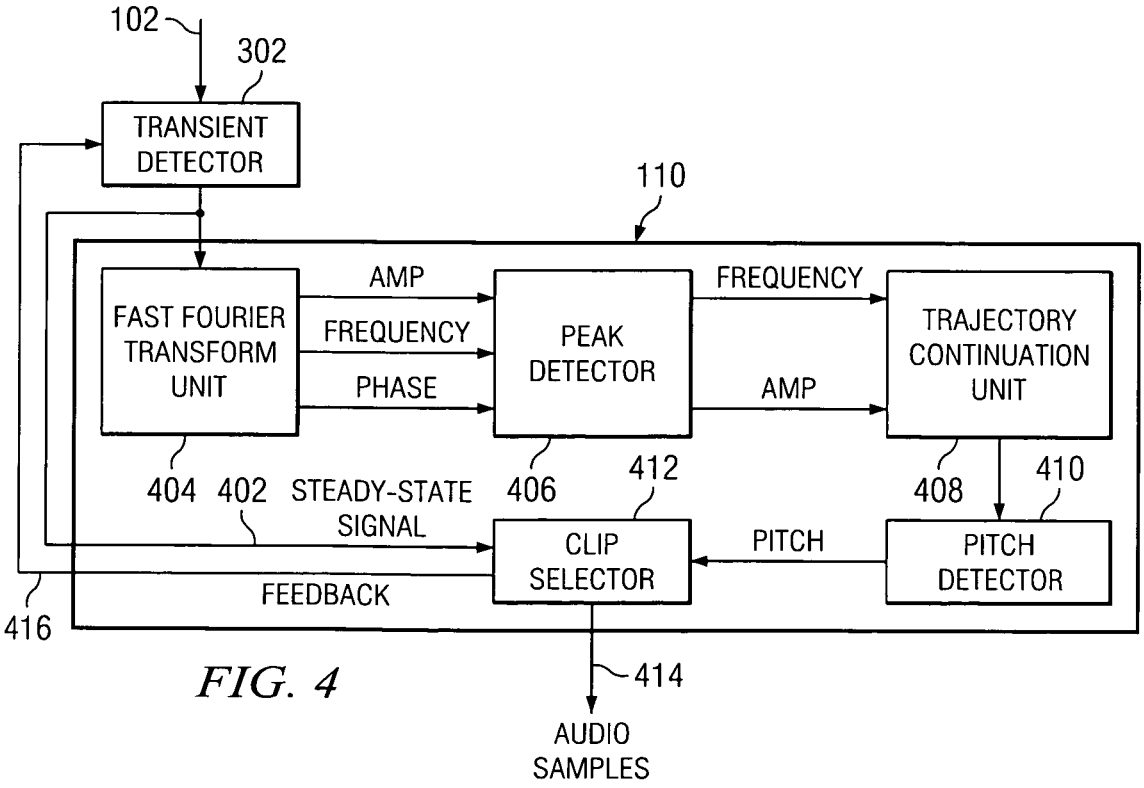
FIG. 4 illustrates an example wavetable generator according to one embodiment of this disclosure.

FIG. 4 illustrates an example wavetable generator 110 according to one embodiment of this disclosure. The embodiment of the wavetable generator 110 shown in FIG. 4 is for illustration only. Other embodiments of the wavetable generator 110 may be used without departing from the scope of this disclosure. Also, for ease of explanation, the wavetable generator 110 in FIG. 4 is described as operating in the audio processing apparatus 100 of FIG. 1. The wavetable generator 110 could be used in any other apparatus or system.

In this example, the wavetable generator 110 receives the output of the transient detector 302. In particular, the wavetable generator 110 receives and processes the regions of an input audio signal 102 that do not contain transients. These regions of the input audio signal 102 may be referred to as steady-state signals 402.

The steady-state signals 402 are provided to a fast Fourier transform unit 404. The fast Fourier transform unit 404 processes the steady-state signals 402 and generates outputs identifying different characteristics of the steady-state signals 402. For example, the fast Fourier transform unit 404 could generate outputs identifying amplitude, frequency, and phase characteristics of the steady-state signals 402. The fast Fourier transform unit 404 includes any hardware, software, firmware, or combination thereof for identifying characteristics of audio signals.

The output of the fast Fourier transform unit 404 is received by a peak detector 406. The peak detector 406 identifies the dominant frequencies present in the amplitude spectrum of the steady-state signals 402. For example, the peak detector 406 could identify the dominant frequency or frequencies present in each frame of the steady-state signals 402. The peak detector 406 then outputs the frequency and amplitude of the dominant frequencies in the steady-state signals 402. The peak detector 406 includes any hardware, software, firmware, or combination thereof for identifying peaks in audio signals.

The output of the peak detector 406 is received by a trajectory continuation unit 408. The trajectory continuation unit 408 verifies whether the identified steady-state signals 402 actually have steady-state characteristics. For example, the transient detector 302 could have identified regions of the input audio signal 102 as lacking transients, while those regions may actually lack steady-state characteristics. The frequencies and amplitudes output by the peak detector 406 form trajectories that the trajectory continuation unit 408 tracks across several frames. To avoid tracking spurious peak frequencies, the trajectory continuation unit 408 chooses trajectories that last over a specified number of frames. Those frames are chosen for additional processing. The trajectory continuation unit 408 includes any hardware, software, firmware, or combination thereof for identifying trajectories over multiple frames.

The output of the trajectory continuation unit 408 is received by a pitch detector 410. The pitch detector 410 identifies the pitch frequency of the steady-state signals 402 using the trajectories of the frequency components present in the signals. For example, the pitch detector 410 could identify the pitch frequency of each frame of the steady-state signals 402 using the trajectories. The identified pitch frequency is then output by the pitch detector 410. The pitch detector 410 includes any hardware, software, firmware, or combination thereof for identifying the pitch frequency of audio signals.

The output of the pitch detector 410 and the steady-state signals 402 are received by a clip selector 412. The clip selector 412 identifies portions or "clips" of the steady-state signals 402 that are used to generate wavetables. For example, the clip selector 412 could select various looping segments 210 from the steady-state signals 402. The clip selector 412 then generates audio samples 414 representing the selected portions of the steady-state signals 402. The audio samples 414 may be stored in a memory 112, such as by being stored in a wavetable in the memory 112.

In some embodiments, the clip selector 412 plays the selected portions of the steady-state signals 402 to a user and allows the user to indicate whether the selected portions are acceptable. If acceptable, the audio samples 414 are stored in the memory. If not, the clip selector 412 generates a feedback signal 416, which causes the transient detector 302 to continue processing the input audio signal 102 and the wavetable generator 110 to select additional portions of the input audio signal 102. The clip selector 412 includes any hardware, software, firmware, or combination thereof for selecting portions of audio signals for storage in a wavetable.

The following description describes an example operation of the wavetable generator 110. The description of the operation of the wavetable generator 110 is for illustration only. The wavetable generator 110 could operate in other ways without departing from the scope of this disclosure.

The fast Fourier transform unit 404 receives frames representing a steady-state portion of the input audio signal 102. The fast Fourier transform unit 404 identifies the amplitude, starting phase, and frequencies of the signal within each frame. The fast Fourier transform unit 404 could implement an N point fast Fourier transform, where N represents the size of the frame. The frame size could, for example, equal a power of two. In other embodiments, the fast Fourier transform unit 404 could be replaced by a Linear Time Invariant filterbank followed by an exponential modulator.

The peak detector 406 identifies peaks in the steady-state portion of the input audio signal 102. The peaks may be chosen based on their relative magnitude difference between neighboring frequency bins. For example, an 80-decibel cutoff criterion could be applied to limit the number of peaks. Logarithmic plots could be used for the peak frequency determination since these plots may be smoother than amplitude spectrum plots. The transform of the amplitude spectrum may be zero-padded, and an inverse Fourier transform can be computed to increase the frequency resolution and smooth the spectrum.

The trajectory continuation unit 408 helps to isolate the steady-state portions of the input audio signal 102 that have desired frequency components. The trajectory continuation unit 408 also helps to ensure that spurious peaks are not chosen for the pitch detection. To help avoid tracking spurious peak frequencies, only trajectories lasting a specified number of frames are chosen for pitch detection.

Figure 5A:
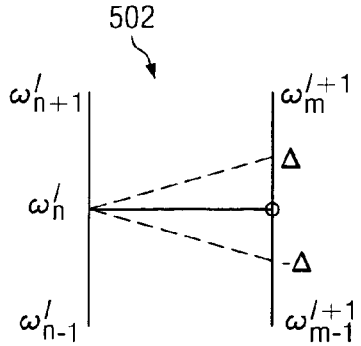
FIGS. 5A through 5C illustrate example trajectory tracking in a wavetable generator according to one embodiment of this disclosure.
Figure 5B:
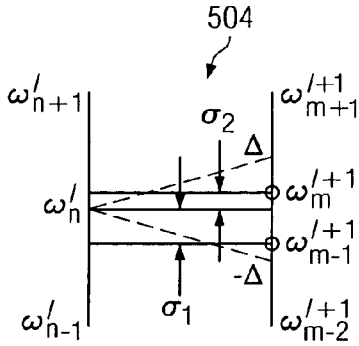
Figure 5C:
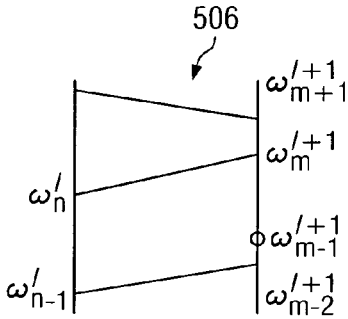

The trajectory tracking scheme includes piecing together parameters that fall within certain minimum frequency deviations and then choosing trajectories that minimize frequency distance between these parameters. For example, a frame may be divided into multiple bins. Assume all of the previous peak frequencies up to bin k in frame l have been matched and that $\omega^l_k$, $A^l_k$ represent the frequency and amplitude parameters of the frequency in bin k in frame l. Spurious peak frequencies may occur in different circumstances. Some of these circumstances are shown in FIGS. 5A through 5C. FIG. 5A includes a plot 502 representing the death or conclusion of a trajectory track, FIG. 5B includes a plot 504 representing the matching of trajectory tracks, and FIG. 5C includes a plot 506 representing the birth or start of a trajectory track.

In FIG. 5A, if $|\omega^l_k-\omega^{l+1}_q|\geqq\Delta$, the trajectory track is said to have died, and $A^{l+1}_k=0$. In FIG. 5B, if $|\omega^l_k-\omega^{l+1}_q|<\Delta$, then $\omega^{l+1}_k$ represents a tentative match. This means that there might be other frequencies in the vicinity that match the desired frequency, and the entire frequency range is checked. In FIG. 5C, if $|\omega^l_k-\omega_{l+1q}|<|\omega^l_k-\omega_{l+1i+1}|$ and frequency $\omega^{l+1}_q$ is not matched to any other frequency and is the closest to $\omega^l_k$, then $\omega^{l+1}_q$ may represent a match. Unmatched frequencies in frame l+1 are designated as born tracks where $A^{l-1}_k=0$. Long duration tracks of trajectories may be stopped or killed if they do not recur within a specified period of time.

Using the trajectory information, the pitch detector 410 identifies the pitch information using any suitable technique. For example, the pitch frequency associated with the $k^{th}$ bin in the $l^{th}$ frame may calculated using the Fourier transform X(l, k) as defined in the equation:

$$\hat{f} = \frac{k}{N} = \frac{\mathrm{Arg}\{X(1,k)\} - \mathrm{Arg}\{X(0,k)\}}{2\cdot\pi\cdot H} \tag{3}$$

where H represents the number of samples separating the bins and N represents the size of the frame.

Accurate peak determination allows the pitch detector 410 to determine the pitch of a portion of the input audio signal 102. The pitch detector 410 also detects harmonics present in the input audio signal 102. Once the peak frequencies and the pitch are identified in the signal 102, any peak falling within a specified range of a harmonic is forced to the frequency of the harmonic. In other words, the pitch detector 410 determines whether $|f-m\cdot f_0|\leqq\delta$, where f represents the peak frequency, $f_0$ represents the fundamental pitch frequency, m represents any integer, and δ represents an arbitrary constant that determines how close a frequency should be before it is forced to the nearest harmonic frequency.

Figure 6:
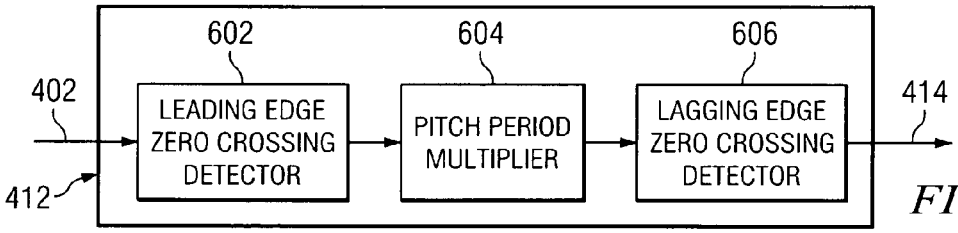
FIG. 6 illustrates an example clip selector in a wavetable generator according to one embodiment of this disclosure.

The clip selector 412 selects portions or clips from the steady-state portion of the input audio signal 102. The selected clips could, for example, represent looping segments 210. The selected clips could have the same pitch frequency, and the clip selector 412 could allow feedback from a user. One example of a clip selector 412 is shown in FIG. 6. The clip selector 412 chooses clips representing looping segments 210 so that artifacts are reduced or eliminated during looping and playback. To help ensure this, the edges at the beginning and the end of a clip are chosen to be zero crossover points. To help prevent mismatch during playback, the slope of the clip at the leading edge may be positive and the slope of the clip at the lagging edge may be negative.

As shown in FIG. 6, the clip selector 412 includes a leading edge zero crossing detector 602, a pitch period multiplier 604, and a lagging edge zero crossing detector 606. The leading edge zero crossing detector 602 identifies the starting point of a clip in a frame. Since the start of a frame might not be a zero crossing, the slope $S_1$ at the starting point may be computed at the first zero crossing point in the frame using the following equation:

$$S_1 = \frac{x_M(l) - x_M(l-1)}{l-(l-1)} = x_M(l) - x_M(l-1) \tag{5}$$

where $x_M(l)$ represents the amplitude of the $l^{th}$ sample in the $M^{th}$ frame. If the slope is not positive, the next zero crossover point is examined as the possible start of a selected clip.

The pitch period multiplier 604 identifies the integral number of cycles of the desired frequencies that are present in the frame. The number of cycles may be determined using the following equation:

$$\Omega = \left\lfloor \frac{N-l}{P} \right\rfloor \tag{6}$$

where N represents the frame size, l represents the number of samples before the leading edge zero at the start of the frame, and P represents the pitch frequency as detected by the pitch detector 410. The $\lfloor x \rfloor$ operation returns the largest integer smaller than x. In particular embodiments, for a good reconstruction, twenty cycles of the steady-state signal 402 are stored for reconstruction. If Ω for a desired frequency is less than twenty, additional cycles from the successive frame may be considered, depending on the output from the trajectory continuation unit 408.

The lagging edge zero crossing detector 606 identifies the ending point of a clip in a frame. The zero crossing closest to point $x_M(l+\Omega P)$ may be considered for computation of the slope $S_2$. The slope $S_2$ at the ending point may be computed using the following equation:

$$S_2 = \frac{x_M(l+\Omega P) - x_M(l+\Omega P-1)}{(l+\Omega P)-(l+\Omega P-1)} = x_M(l+\Omega P) - x_M(l+\Omega P-1). \tag{7}$$

To maintain phase coherence, the slopes $S_1$ and $S_2$ of the samples being spliced together may have the same sign. If the slopes do not have the same sign, the next zero crossing is considered for termination of the extracted audio samples. The amplitude of the frame is another criterion that may be used to help ensure that the samples selected do not create artifacts during synthesis.

The output of the clip selector 412 represents audio samples 414. As described above, in some embodiments, the user of the audio processing apparatus 100 could be given the option of reviewing the selected audio samples 414. The selected samples 414 may be played back to obtain user feedback. If the samples are accepted, the samples 414 may be stored in a memory, such as in a wavetable in the memory. If the samples are not accepted, the audio processing apparatus 100 may continue to search for samples at a desired frequency.

Figure 7:
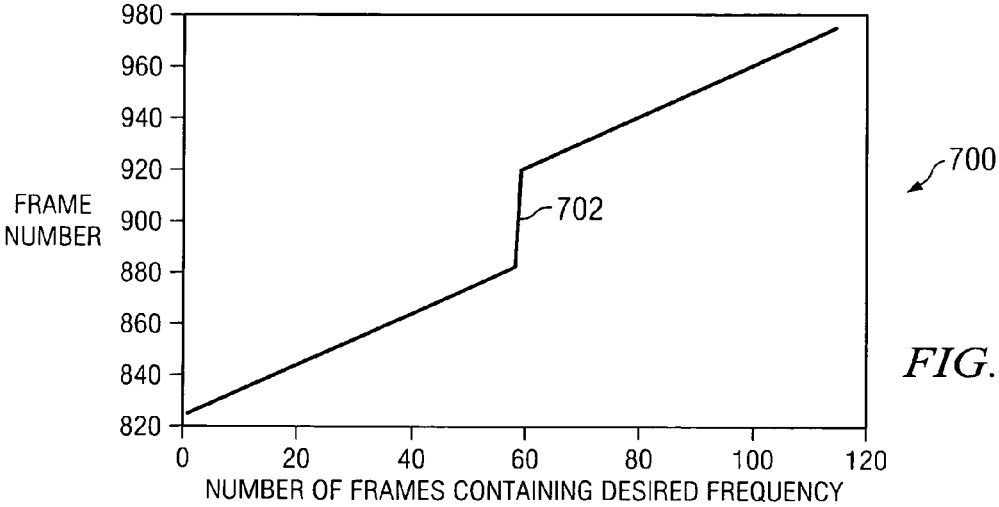
FIG. 7 illustrates an example isolation of audio frames having a desired frequency according to one embodiment of this disclosure.

The audio processing apparatus 100 is able to automatically capture samples of a desired frequency from input audio signals using transient detection, pitch detection, and trajectory continuation mechanisms. An example of the operation of the audio processing apparatus 100 is shown in FIG. 7. FIG. 7 illustrates a plot 700, where the vertical axis lists the frame number of frames being processed and the horizontal axis shows the number of identified frames having a desired frequency. A constant slope indicates that the desired frequency is contained in a sequence of frames. For example, the sixty frames 820-880 in the plot all contain the desired frequency (shown by an increase of sixty frames along the horizontal axis). Similarly, the sixty frames 920-980 in the plot all contain the desired frequency (shown by another increase of sixty frames along the horizontal axis). A change in the slope, such as in portion 702 of the plot 700, indicates that the desired frequency is missing in one or more frames. In this example, very few or none of the forty frames 880-920 contains the desired frequency (shown by small or no increase along the horizontal axis). In some embodiments, the plot 700 should represent a monotonically increasing function since the frame number along the vertical axis is constantly increasing.

Once the audio samples 414 containing a desired frequency are identified, the audio samples 414 may be stored and used in any suitable manner. For example, the audio samples 414 could represent a looping segment 210 stored in a wavetable, and the audio samples 414 could be retrieved from the wavetable, looped, and subjected to an envelope function to produce output signals. The attack and decay sections of a tone could also be stored in the wavetable. As a particular example, the audio samples 414 may be used by a pitch scaling algorithm, and Attack-Decay-Sustain-Release ("ADSR") information may be extracted to generate synthetic audio signals.

This represents one possible implementation of the audio processing apparatus 100. The mechanism used by the audio processing apparatus 100 could be used in any other suitable device or system. In other embodiments, the mechanism described above could be used as a post-processing block in various decoding applications, such as in a Moving Picture Experts Group Layer III ("MP3") decoder. In these embodiments, the frequency trajectories may be computed without using a fast Fourier transform unit. The MP3 decoder already has a subband filter with frequency and amplitude parameters, and these parameters can be used for transient detection, trajectory continuation, and other operations.

Although FIG. 4 illustrates one example of a wavetable generator 110, various changes may be made to FIG. 4. For example, the functional division of the wavetable generator 110 shown in FIG. 4 is for illustration only. Various components in FIG. 4 may be combined or omitted and additional components could be added according to particular needs. Also, while FIGS. 5-7 have illustrated various operations of the wavetable generator 110, the wavetable generator 110 could operate in any other or additional manner.

Figure 8:
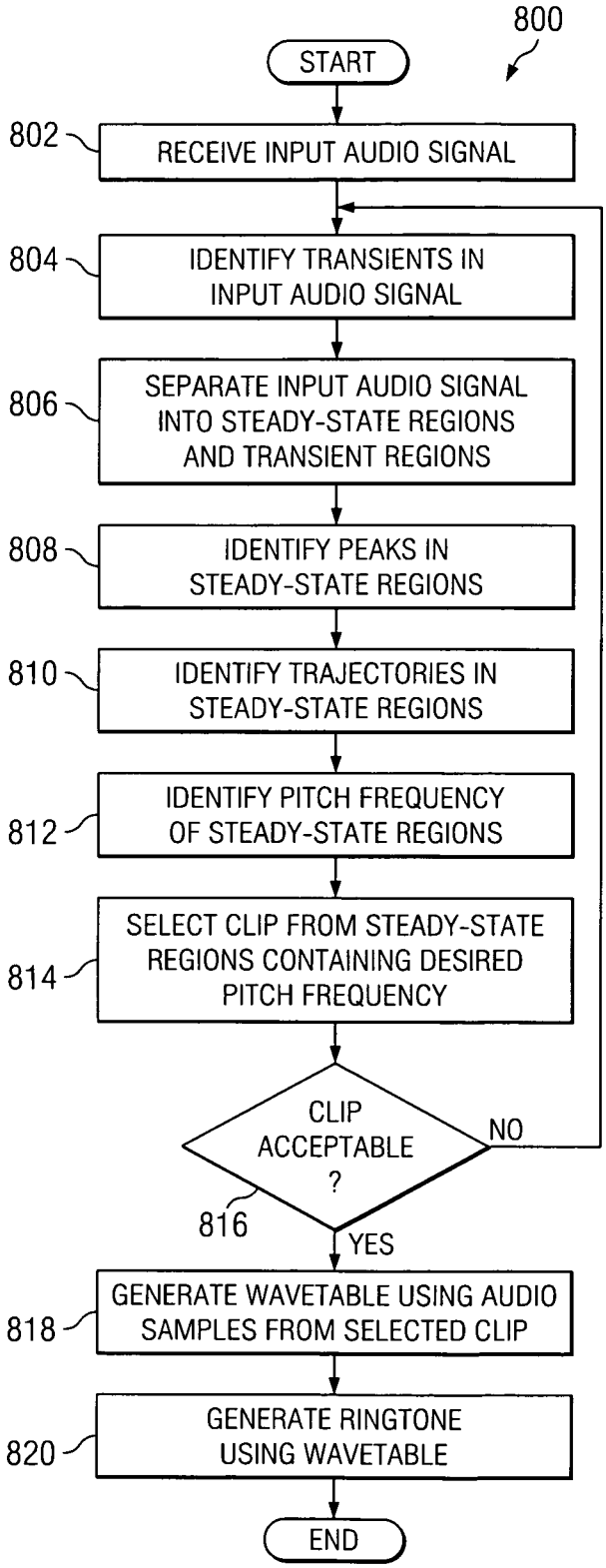
FIG. 8 illustrates an example method for generating audio wavetables according to one embodiment of this disclosure.

FIG. 8 illustrates an example method 800 for generating audio wavetables according to one embodiment of this disclosure. For ease of explanation, the method 800 is described with respect to the audio processing apparatus 100 of FIG. 1. The method 800 could be used by any other device or system.

The audio processing apparatus 100 receives an input audio signal at step 802. This may include, for example, the input interface 106 receiving an input audio signal 102. The input interface 106 could receive the input audio signal 102 over an audio cable, over a wireline or wireless network, from an optical storage medium such as a CD or DVD, or from any other source of audio information.

The audio processing apparatus 100 identifies transients in the input audio signal at step 804. This may include, for example, the transient detector 302 receiving the input audio signal 102 and identifying transients in the input audio signal 102. As particular examples, the transient detector 302 could identify the transients by comparing a current frame's energy estimate to an average or weighted sum of prior frames' energies and/or by identifying a ratio of residual energy and original frame energy.

The audio processing apparatus 100 separates the input audio signal into steady-state regions and transient regions at step 806. This may include, for example, the transient detector 302 identifying steady-state signals 402 that do not contain transients in the input audio signal 102.

The audio processing apparatus 100 identifies peaks in the steady-state regions of the input audio signal at step 808. This may include, for example, the peak detector 406 identifying peaks in the steady-state signals 402. As a particular example, the peaks could be identified using logarithmic plots of the steady-state signals 402.

The audio processing apparatus 100 identifies trajectories in the steady-state regions of the input audio signal at step 810. This may include, for example, the trajectory continuation unit 408 using the frequencies and amplitudes from the peak detector 406 to identify trajectories across several frames.

The audio processing apparatus 100 identifies pitch frequencies in the steady-state regions of the input audio signal at step 812. This may include, for example, the pitch detector 410 using the trajectories from the trajectory continuation unit 408 to identify the pitch frequencies in the steady-state signals 402.

The audio processing apparatus 100 selects a clip from the steady-state regions of the input audio signal at step 814. This may include, for example, the clip selector 412 identifying a portion of the steady-state signals 402 having a desired pitch frequency. This may also include the clip selector 412 outputting audio samples from the portion of the steady-state signals 402 having the desired pitch frequency.

The audio processing apparatus 100 determines whether the selected clip is acceptable at step 816. This may include, for example, the audio processing apparatus 100 playing back the selected clip for a user. This may also include the user pressing a button, a sequence of buttons, speaking an acceptance, or otherwise indicating that the user accepts the selected clip. If the selected clip is not acceptable, the audio processing apparatus 100 returns to step 804 to identify another portion of the input audio signal that could be used as a clip.

If the clip is accepted, the audio processing apparatus 100 may use the selected clip in any suitable manner. In this example, the audio processing apparatus 100 generates an audio wavetable using the audio samples from the selected clip at step 818. This may include, for example, the audio processing apparatus 100 storing audio samples 414 in a solid-state or other memory. The audio processing apparatus 100 then generates a ringtone using the wavetable at step 820. This may include, for example, the audio processing apparatus 100 retrieving the audio samples 414 from the wavetable and synthesizing an instrument tone using the audio samples.

Although FIG. 8 illustrates one example of a method 800 for generating audio wavetables, various changes may be made to FIG. 8. For example, the user may not be given the option of accepting or rejecting a selected clip, and step 816 could be omitted.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, or software, or a combination of at least two of the same. It should be noted that the functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method, comprising:

in response to receiving an audio signal comprising at least a steady-state segment preceded by a first transient segment and followed by a second transient segment, identifying peaks in the received audio signal having an amplitude higher than signals at neighboring frequencies;

selecting a subset of the identified peaks between a start and an end of the steady-state segment within the received audio, the subset of identified peaks corresponding to trajectories that last over a specified number of frames;

identifying at least one pitch frequency and amplitude within the steady-state segment of the received audio signal based on the subset of the identified peaks;

identifying and selecting a portion of the steady-state segment that (a) contains the pitch frequency and (b) begins and ends at zero crossover points;

responsive to selection of the identified portion of the steady-state segment, generating a wavetable using audio samples of the received audio signal within the selected portion of the steady-state segment, wherein looping one or more of the audio samples stored in the wavetable synthesizes an output audio signal corresponding to the steady-state segment.

2. The method of claim 1, further comprising:

identifying transients in the received audio signal; and dividing the received audio signal into one or more segments containing transients and one or more steady-state segments lacking transients.

3. The method of claim 1, further comprising:

identifying amplitude, frequency, and phase characteristics of at least one portion of the received audio signal.

4. The method of claim 3, further comprising:

identifying the peaks in the at least one received audio signal portion using the identified amplitude, frequency, and phase characteristics.

5. The method of claim 3, wherein the received audio signal is divided into frames.

6. The method of claim 4, further comprising:

identifying one or more pitch frequencies associated with the at least one received audio signal portion.

7. The method of claim 1, further comprising:

identifying one or more steady-state segments having the pitch frequency.

8. The method of claim 1, further comprising:

identifying a leading zero crossing and a lagging zero crossing separated from the leading zero crossing in the steady-state segment; and selecting the portion of the steady-state segment between the leading zero crossing and the lagging zero crossing as the identified portion.

9. The method of claim 1, further comprising:

presenting the identified portion of the steady-state segment to a user; and determining whether the user accepts the identified portion of the steady-state segment.

10. The method of claim 1, further comprising:

storing audio samples from the identified portion of the steady-state segment in the wavetable.

11. The method of claim 1, further comprising:
synthesizing the output audio signal using the wavetable.

12. The method of claim 1, further comprising:
applying an envelope function to each looped portion.

13. The method of claim 11, further comprising:
synthesizing a ringtone in a mobile telephone using the wavetable.

14. The method of claim 13, further comprising:
synthesizing a ringtone associated with one or more musical instruments identified by a user, the wavetable associated with at least one of the musical instruments.

15. An apparatus, comprising:
an audio decomposer configured to identify one or more steady-state segments of a received audio signal comprising at least a steady-state segment preceded by a first transient segment and followed by a second transient segment;
a wavetable generator configured to:
identify peaks in the received audio signal having an amplitude higher than signals at neighboring frequencies;
select a subset of the identified peaks between a start and an end of the steady-state segment within the received audio, the subset of identified peaks corresponding to trajectories that last over a specified number of frames;
identify at least one pitch frequency and amplitude within the steady-state segment of the received audio signal based on the subset of the identified peaks;
identify and select at least one portion of the steady-state segment that (a) contains the pitch frequency and (b) begins and ends at zero crossover points; and
generate a wavetable using audio samples of the received audio signal within the at least one identified portion of the steady-state segment, wherein looping the audio samples synthesizes an output audio signal corresponding to the steady-state segment; and
a memory configured to store the wavetable.

16. The apparatus of claim 15, wherein the wavetable generator comprises:
a transform unit configured to identify amplitude, frequency, and phase characteristics of the received audio signal;
a peak detector configured to identify the peaks in the received audio signal using the identified amplitude, frequency, and phase characteristics;
a pitch detector configured to identify one or more pitch frequencies associated with the one or more steady-state segments; and
a clip selector configured to identify at least one portion of the one or more steady-state segments having the pitch frequency.

17. The apparatus of claim 16, wherein:
the received audio signal is divided into frames.

18. The apparatus of claim 16, wherein the clip selector is configured to:
identify a leading zero crossing and a lagging zero crossing separated from the leading zero crossing in one of the one or more steady-state segments; and
select the portion of the one steady-state segment between the leading zero crossing and the lagging zero crossing.

19. The apparatus of claim 15, further comprising:
a sound engine configured to synthesize the output audio signal using the wavetable.

20. The apparatus of claim 19, wherein the sound engine is configured to synthesize the output audio signal by synthesizing a ringtone using the wavetable.

21. The apparatus of claim 15, wherein the apparatus comprises a mobile telephone, the mobile telephone further comprising a keypad, a display, a speaker, a microphone, a transceiver, and an antenna.

22. The apparatus of claim 15, wherein the apparatus comprises a decoder, the decoder further comprising a subband filter.

23. An apparatus, comprising:
one or more processors collectively configured to:
in response to receiving an audio signal comprising at least a steady-state segment preceded by a first transient segment and followed by a second transient segment, identify the steady-state segment of a received audio signal by:
identifying peaks in the received audio signal having an amplitude higher than signals at neighboring frequencies, and
selecting a subset of the identified peaks between a start and an end of the steady-state segment within the received audio, the subset of identified peaks corresponding to trajectories that last over a specified number of frames;
identify at least one pitch frequency and amplitude within the steady-state segment of the received audio signal based on the subset of the identified peaks;
based on the subset of the identified peaks, identify and select at least one portion of the steady-state segment that contains the pitch frequency and begins and ends at zero crossover points; and
generate a wavetable using audio samples of the received audio signal within the at least one identified portion of the steady-state segment, wherein looping audio samples stored in the wavetable synthesizes an output audio signal corresponding to the steady-state segment; and
a memory configured to store the wavetable.

24. The apparatus of claim 23, wherein the one or more processors are collectively configured to:
identify amplitude, frequency, and phase characteristics of at least one portion of the received audio signal;
identify the peaks in the at least one received audio signal portion using the identified amplitude, frequency, and phase characteristics;
identify one or more pitch frequencies associated with the at least one received audio signal portion; and
identify at least one portion of the steady-state segment having the pitch frequency.

25. A computer program product embodied on a computer readable medium and capable of being executed by a processor, the computer program comprising computer readable program code for:
in response to receiving an audio signal comprising at least a steady-state segment preceded by a first transient segment and followed by a second transient segment, identifying the steady-state segment of a received audio signal by:
identifying peaks in the received audio signal having an amplitude higher than signals at neighboring frequencies,
selecting a subset of the identified peaks between a start and an end of the steady-state segment within the received audio, the subset of identified peaks corresponding to trajectories that last over a specified number of frames;
identifying at least one pitch frequency and amplitude within the steady-state segment of the received audio signal based on the subset of the identified peaks;

identifying at least one portion of the steady-state segment that contains the pitch frequency and begins and ends at zero crossover points;

generating a wavetable using audio samples of the received audio signal within the at least one identified portion of the steady-state segment, wherein looping the audio samples synthesizes an output audio signal corresponding to the steady-state segment.

26. The computer program product of claim 25, further comprising computer readable program code for:

identifying amplitude, frequency, and phase characteristics of at least one portion of the received audio signal;

identifying the peaks in the at least one received audio signal portion using the identified amplitude, frequency, and phase characteristics;

identifying one or more pitch frequencies; and identifying at least one portion of the steady-state segment having the pitch frequency.

27. The computer program product of claim 26, wherein the audio signal is divided into frames.

28. The computer program product of claim 26, further comprising computer readable program code for:

identifying a leading zero crossing and a lagging zero crossing in the steady-state segment; and selecting the portion of the steady-state segment between the leading zero crossing and the lagging zero crossing.

29. The computer program product of claim 25, further comprising computer readable program code for:

presenting the at least one identified portion of the steady-state segment to a user; and determining whether the user accepts the at least one identified portion of the steady-state segment.

30. The computer program product of claim 25, further comprising computer readable program code for:

synthesizing the output audio signal using the wavetable.

31. The computer program product of claim 30, further comprising computer readable program code for:

synthesizing a ringtone in a mobile telephone using the wavetable.

* * * * *